US009718641B2

(12) United States Patent
Finschi

(10) Patent No.: US 9,718,641 B2
(45) **Date of Patent: *Aug. 1, 2017**

(54) RETROFITTING AN ELEVATOR CALL INPUT DEVICE

(71) Applicant: Inventio AG, Hergiswil NW (CH)

(72) Inventor: Lukas Finschi, Ebikon (CH)

(73) Assignee: Inventio AG, Hergiswil NW (CH)

( * ) Notice: Subject to any disclaimer, the term of this patent is extended or adjusted under 35 U.S.C. 154(b) by 304 days.

This patent is subject to a terminal disclaimer.

(21) Appl. No.: 14/303,156

(22) Filed: Jun. 12, 2014

(65) Prior Publication Data

US 2015/0041254 A1 Feb. 12, 2015

Related U.S. Application Data

(63) Continuation of application No. 13/119,776, filed as application No. PCT/EP2009/062139 on Sep. 18, 2009, now Pat. No. 8,763,762.

(60) Provisional application No. 61/098,301, filed on Sep. 19, 2008.

(30) Foreign Application Priority Data

Sep. 19, 2008 (EP) ..... 08164718

(51) Int. Cl.
*B66B 1/34* (2006.01)
*B66B 1/46* (2006.01)

(52) U.S. Cl.
CPC ..... *B66B 1/3423* (2013.01); *B66B 1/3407* (2013.01); *B66B 1/468* (2013.01)

(58) Field of Classification Search
CPC ..... B66B 1/3423; B66B 1/3407; B66B 1/468
USPC ..... 187/247, 391–396, 399, 901
See application file for complete search history.

(56) References Cited

U.S. PATENT DOCUMENTS

| | | | |
|---|---|---|---|
| 4,716,992 | A | 1/1988 | Kunii |
| 5,679,934 | A | 10/1997 | Juntunen et al. |
| 5,689,094 | A | 11/1997 | Friedli et al. |
| 5,986,224 | A | 11/1999 | Kent |
| 6,326,934 | B1 | 12/2001 | Kinzie |
| 6,502,668 | B1 | 1/2003 | Chida et al. |
| 6,801,792 | B1 | 10/2004 | Schuster et al. |
| 6,828,918 | B2 | 12/2004 | Bowman et al. |
| 6,902,041 | B2 | 6/2005 | Eccleston |

(Continued)

FOREIGN PATENT DOCUMENTS

| | | | |
|---|---|---|---|
| EP | 1308409 | A1 | 5/2003 |
| EP | 1598298 | A1 | 11/2005 |

(Continued)

OTHER PUBLICATIONS

Translation JP2003261267(A) Sep. 16, 2003.*

(Continued)

*Primary Examiner* — Anthony Salata
(74) *Attorney, Agent, or Firm* — Stroock & Stroock & Lavan LLP

(57) ABSTRACT

A lift system comprises a call input device and at least one touchscreen for inputting a call for a lift. The touchscreen has at least one functional identifier. When a functional identifier is touched, at least one input signal is generated. The call input device converts into a special input mode for a time-specific or location-specific generation of several input signals.

12 Claims, 4 Drawing Sheets

(56) References Cited

U.S. PATENT DOCUMENTS

| | | | | |
|---|---|---|---|---|
| 7,145,433 | B2 | 12/2006 | Gerstenkorn | |
| 7,207,422 | B2 | 4/2007 | Takeuchi | |
| 7,496,445 | B2 | 2/2009 | Mohsini et al. | |
| 7,593,000 | B1 | 9/2009 | Chin | |
| 7,597,177 | B2 | 10/2009 | Oh et al. | |
| 8,174,503 | B2 | 5/2012 | Chin | |
| 8,336,678 | B2 | 12/2012 | Poutiainen et al. | |
| 8,505,693 | B2 | 8/2013 | Koba | |
| 8,514,183 | B2 | 8/2013 | Westerman et al. | |
| 8,757,329 | B2 * | 6/2014 | Taiana | B66B 1/468 187/391 |
| 8,763,762 | B2 * | 7/2014 | Finschi | B66B 1/468 187/391 |
| 2004/0000453 | A1 | 1/2004 | Eccleston | |
| 2005/0252725 | A1 | 11/2005 | Felder et al. | |
| 2011/0157079 | A1 | 6/2011 | Wu et al. | |
| 2011/0251954 | A1 | 10/2011 | Chin | |
| 2012/0317521 | A1 | 12/2012 | Ludwig | |
| 2014/0014444 | A1 * | 1/2014 | Kauppinen | B66B 1/468 187/389 |

FOREIGN PATENT DOCUMENTS

| | | | |
|---|---|---|---|
| EP | 1609752 | A1 | 12/2005 |
| EP | 1864933 | A1 | 12/2007 |
| EP | 2159183 | A1 | 3/2010 |
| JP | 03-284589 | A | 12/1991 |
| JP | 06-144726 | A | 5/1994 |
| JP | 05-336647 | A1 | 12/1996 |
| JP | 2001-002331 | A | 1/2001 |
| JP | 2003-048671 | A | 2/2003 |
| JP | 2003-213267 | A | 8/2003 |
| JP | 2003-261267 | A | 9/2003 |
| JP | 2005-143967 | A | 6/2005 |
| JP | 2006-056700 | A | 3/2006 |
| KR | 20060081076 | | 3/2005 |
| KR | 20050019726 | | 12/2006 |
| WO | 2005/118450 | A1 | 12/2005 |
| WO | 2007/046807 | A1 | 4/2007 |
| WO | 2008/085855 | A1 | 7/2008 |
| WO | 2008/101518 | A1 | 8/2008 |
| WO | 2008/155836 | A1 | 12/2008 |

OTHER PUBLICATIONS

Apple iPhone wikipedia.

Apple presentation dated Jan. 9, 2007.

Opposition against EP2331443 B1 filed by Otis Elevator Company dated Feb. 17, 2014.

Office Action from Korean Patent Application No. 2011-7008816, mailed on Dec. 19, 2015.

* cited by examiner

| Element | Name | Element | Name |
|---|---|---|---|
| 1, 1' | Input device | 9, 9' | Door drive |
| 2, 2' | Bus system | 10, 10' | Elevator drive |
| 4, 4' | Destination call controller | 11, 11' | Floor door |
| 5, 5' | Elevator controller | 12, 12' | Elevator door |
| 6, 6' | Car | 14, 14' | Signal line |
| 7, 7' | Counterweight | S1, S2, S3 | Floor |
| 8, 8' | Support | S4, S4' | Shaft |

RETROFITTING AN ELEVATOR CALL INPUT DEVICE

This application is a continuation of U.S. patent application Ser. No. 13/119,776, filed on May 20, 2011, which is a national phase application under §371 of, and claims priority to PCT/EP2009/062139, filed on Sep. 18, 2009, which in turn claims priority to U.S. Provisional Application No. 61/098,301, filed on Sep. 19, 2008 and European Patent Application No. 08164718.2, filed on Sep. 19, 2008, the entire contents of all applications are expressly incorporated herein by reference.

The disclosure relates to elevator call input devices and the use of such devices.

BACKGROUND

It is known that an elevator having an elevator car transports passengers between floors in a building. For this purpose, the passengers enter floor calls or car calls on input devices which are arranged on the floors and in elevator cars. Within the process of ensuring equality for passengers with disabilities, European Standard 81-70 for this purpose specifies a pushbutton for the disabled. The elevator is changed to a specific operating mode by pushing the pushbutton for the disabled. In this operating mode, elevator doors are opened and closed more slowly on the floors and on the elevator cars, and passengers with disabilities receive feedback from the call input via visible and/or audible signals.

EP 1 864 933 A1 discloses an elevator having a call input device. The car call input device has a touchscreen with a wheelchair switching button. When the wheelchair switching button on the touchscreen is touched, the elevator changes to a specific operating mode. The wheelchair switching button on the touchscreen does not comply with EN81-70 since it can neither be sensed by a relief of at least 0.8 mm on the touchscreen nor can it be switched only by a pressure force of 2.5 N to 5.0 N.

The document EP 1 864 933 A describes a touchscreen for inputting a call describes a touchscreen for inputting a call by means of a wheelchair button. This wheelchair button switches the elevator installation to a specific operating mode (column 5, lines 4-9), in order to allow the elevator journey to be carried out more pleasantly by the person who has pushed the wheelchair button.

The document JP 2003 261267 A describes a call input unit having a disabled button. If this button is pressed at the same time as the call input button, then the elevator journey is carried out in a specific operating mode.

The document JP 2001 002331 A describes a call input unit having call input buttons and a touch sensor. When a person touches the call input unit when a call input button is pressed within a time interval, it is assumed that a blind person wishes to travel in the elevator.

The document EP 1 308 409 A describes a destination determination and access control method for an elevator installation. An identified identification code, which has been entered in a suitable unit, is associated with a stored user profile.

The document EP 1 598 298 A describes a call input unit having pushbuttons and a touchscreen located beneath them. When a pushbutton is pressed mechanically, then the pushbutton acts on the touchscreen and initiates an elevator movement.

As a solution which complies with EN81-70, EP1598298A1 teaches the fitting of a pushbutton for the disabled on a touchscreen. An upper face of the pushbutton for the disabled can be identified clearly by the blind by Braille script characters with a relief height of at least 0.8 mm. An area of the touchscreen below the pushbutton for the disabled is operated, and a car call is produced, by pushing the pushbutton for the disabled with a pressure force of 2.5N to 5.0N.

SUMMARY

In some embodiments of a method for an elevator installation having a call input device having at least one touchscreen for inputting at least one call for an elevator installation, the touchscreen has at least one functional designator. At least one input signal is produced when a functional designator is touched. The call input device changes to at least one specific input mode for a plurality of input signals to be produced on a time or position basis.

In some embodiments, this can have the advantage that a passenger with a disability can change a call input device with a touchscreen to a specific input mode by a plurality of input signals being produced on a time or position basis, and this passenger is thus transported in the building without any disadvantage by the elevator installation. The passenger with a disability can therefore take part more easily in commercial life, can make social contacts, can carry out training and development, and can carry out a work activity more easily. In contrast to the prior art, the passenger with the disability does not touch a wheelchair switching button on a touchscreen or press a pushbutton for the disabled on a touchscreen, but produces a plurality of input signals, which are correlated with one another on a time and/or position basis, on the touchscreen, thus changing the call input device to a specific input mode. In at least some embodiments, only in the specific input mode is the call input device activated to produce at least one first input signal and/or at least one further input signal which is impossible in the normal input mode of the call input device.

In further embodiments, as soon as the call input device is in the specific input mode, the touching of at least one first functional designator advantageously produces a first input signal.

In at least some cases, this has the advantage that, in the specific input mode of the call input device, a first functional designator is activated, which the passenger with a disability touches in order to produce a first input signal. In the normal input mode, no such first input signal can be produced, preventing undesired or incorrect production of a first input signal.

Possibly, the touching of at least one further functional designator produces a further input signal. Possibly, the call input device allocates at least one call signal to the further input signal.

This can have the advantage that the passenger can produce a call signal by touching a further functional designator on the call input device.

In some embodiments, the call input device produces a plurality of position-based input signals when a functional designator is touched for a long time, and/or the call input device produces one of a plurality of position-based input signals when a functional designator is touched with at least a specific pressure force, and/or the call input device produces a plurality of position-based input signals when a functional designator is touched at specific times, and/or the call input device produces a plurality of time-based input signals when a plurality of functional designators are touched at the same time, and/or the call input device produces a plurality of position-based input signals when a plurality of functional designators are touched at specific times. In some embodiments, the call input device produces a further input signal when a plurality of further functional designators are touched in the form of at least one geometric pattern; and/or the call input device allocates at least one call signal to the further input signal.

In some embodiments, the geometric pattern is a digit or a letter, and/or a straight line and/or a curved line, and/or is a multiple line.

This can have the advantage that the passenger with the disability produces a plurality of input signals on a time basis and/or position basis simply by placing his hand on the touchscreen, by touching the touchscreen with a specific pressure force, and/or by intuitively producing a geometric pattern. The passenger can therefore define a number such as "6" or "16" on the touchscreen, which number is detected by the call input device as further input signals and is identified as a call signal for a sixth or sixteenth destination floor. The passenger can therefore notify his disability by drawing a letter "B" on the touchscreen, and this letter is identified by the call input device as a first input signal, thus changing the call input device to the specific input mode.

The call input device can have at least one microphone; this microphone produces at least one analog speech signal for at least one spoken command. The call input device associates at least one input signal with the analog speech signal.

This can have the advantage that the passenger can produce an input signal simply by stating a simple spoken command.

In further embodiments, the call input device has at least one microphone which produces at least one analog speech signal for at least one spoken command. The call input device associates at least one input signal with the analog speech signal. When at least one first input signal is associated with at least one first analog speech signal, the call input device changes to at least one specific input mode.

This can have the advantage that the passenger with a disability changes the call input device to a specific input mode by stating a command simply and directly.

In some embodiments, the call input device transmits the first input signal to at least one destination call controller and/or elevator controller. The destination call controller and/or the elevator controller changes the elevator installation to at least one specific operating mode for a received first input signal.

This can have the advantage that the passenger with a disability changes the elevator installation to a specific operating mode by touching a first functional designator and/or by stating a command simply and directly, with the passenger with a disability in this way being transported without any disadvantage by the elevator installation in the building.

In further embodiments, the touching of at least one further functional designator produces a further input signal. The call input device associates at least one call signal with the further input signal. Possibly, the call input device has at least one microphone which produces at least one further analog speech signal for at least one spoken command. The call input device associates at least one call signal with the further analog speech signal. In some cases, the call input device transmits the further input signal to the destination call controller and/or the elevator controller. The destination call controller and/or the elevator controller makes at least one call for a received call signal.

This can mean that a passenger with a disability can produce a call signal for the elevator installation by touching a further functional designator and/or by means of a spoken command.

The touching of at least one first functional designator possibly changes the elevator installation to a specific operating mode for a predetermined time period of five seconds to twenty seconds. Possibly, the touching of at least one first functional designator and the touching of at least one further functional designator on one and the same call input device change the elevator installation to a specific operating mode until the call which is made by the touching of the further functional designator has been carried out completely.

This can mean that, once the elevator installation has been changed to the specific operating mode on a call input device, the passenger with a disability can produce a call which is handled by the elevator installation in the specific operating mode.

The first input signal possibly indicates that a passenger can move or can be oriented in the building only using at least one disabled-specific aid. The first input signal advantageously indicates that a passenger can move or can be oriented in the building only using at least one disabled-specific aid; which disabled-specific aid is a wheelchair or a hospital bed on rollers, or a crutch, or a hearing aid, or a vision aid, or a blind person's stick, or a guide dog for the blind, or an accompanying passenger.

This can mean that the passenger with a disability can indicate that he can move or can be oriented in the building only with a disabled-specific aid.

In some cases, the first input signal indicates that a passenger can move in the building only using at least one personal-protection-specific aid. Possibly, the first input signal indicates that a passenger can move in the building only using at least one personal-protection-specific aid; which personal-protection-specific aid is a three-dimensional protection zone, a time protection zone or a personal protector.

This can mean that personal safety of the passenger against attacks by third parties can be ensured in the building even when conveying a passenger who needs protection, that is to say a passenger with a potential security risk using the elevator car.

Further embodiments comprise a method for operation of an elevator installation, wherein at least one elevator door is closed with a particularly long delay and/or particularly slowly for a passenger having at least one disabled-specific aid.

This can mean that a passenger with a disability has sufficient time to enter and leave the elevator car.

Further embodiments comprise a method for operation of an elevator installation, wherein at least one elevator car is stopped with particular accuracy at a floor for a passenger having at least one disabled-specific aid.

This can mean that the passenger with a disability can enter and leave the elevator car without any steps.

In further embodiments of a method for operation of an elevator installation, a passenger having at least one disabled-specific aid and/or at least one personal-protection-specific aid is assigned a particularly large amount of space in at least one elevator car.

This can mean that the passenger with a disability has a large amount of space for his disabled-specific aid and/or personal-protection-specific aid.

In further embodiments of a method for operation of an elevator installation, a passenger having at least one personal-protection-specific aid is transported by at least one elevator car from a call input floor directly to a destination floor.

This can mean that a passenger with a disability is conveyed directly and therefore quickly to the desired destination floor.

In some cases, at least one input signal is confirmed visually or audibly by at least one acknowledgement signal on the touchscreen and/or by at least one tone transmitter of the call input device.

This can mean that the passenger receives feedback on the call input device in response to the production of an input signal.

In further embodiments, the acknowledgement signal confirms that the elevator installation has been changed to the specific operating mode. In some cases, the acknowledgement signal confirms that the elevator installation has been changed to the normal operating mode.

This can mean that the passenger with a disability is informed of the start and end of the specific operating mode.

In some embodiments, the acknowledgment signal is used to check whether the passenger has at least one disability.

This can mean that it is possible to distinguish between different disabilities of passengers with a disability, and in some cases to deliberately take account of contradictory elevator-installation-specific parameters.

In further embodiments, the acknowledgement signal is used to check for at least one communication language desired by the passenger.

This can mean that the passenger can state his preferred communication language.

In additional embodiments, the acknowledgment signal provides at least one aid.

This can mean that the passenger receives interactive aid for using the call input device.

In some embodiments, at least one direction of travel desired by the passenger is output with the acknowledgement signal. In further embodiments, a destination floor desired by the passenger is output with the acknowledgement signal. In additional embodiments, at least one elevator shaft which is handling a call is identified by the acknowledgement signal. In further embodiments, at least one start and/or at least one duration of opening/closing of an elevator door is output with the acknowledgment signal. Possibly, at least one arrival time of an elevator car at a start floor and/or at a destination floor is output with the acknowledgment signal.

This can mean that the passenger receives a wide range of useful and helpful information from the call input device, which information makes it easier and pleasant to travel using the elevator installation.

In some embodiments, one of a plurality of functional designators is selected depending on the time duration of touching at least one input area on the touchscreen. In further embodiments, at least one acknowledgement signal is output, when the input area on the touchscreen is touched for a long time. At least one input signal is selected when the touching of the input area on the touchscreen for a long time ends. The selected input signal is transmitted to the destination call controller or the elevator controller by the call input device.

This can mean that the passenger with a disability can easily and intuitively use the switch to report his disability to the call input device.

In further embodiments, a call input device comprises a processor and at least one touchscreen for inputting at least one call for an elevator installation. The touchscreen has at least one functional designator. The touching of a functional designator produces at least one input signal. The processor sets the call input device to at least one specific input mode, in order to produce a plurality of input signals on a time and/or position basis.

In some embodiments, at least one first functional designator is characterized by a wheelchair user pictogram, and/or at least one first functional designator is characterized by a VIP written text.

This can mean that the first functional designator can be identified clearly and uniquely by a passenger with a disability.

In additional embodiments, at least one designator is fitted in a force-fitting and/or interlocking and/or integral form in at least one input area of at least one first functional designator on the touchscreen, and/or at least one identifier having at least one Braille script character with a height of at least 0.8 mm is fitted in at least one input area of at least one first functional designator on the touchscreen.

This can mean that an identifier which can be fitted easily, quickly and reversibly in the input area of the first functional designator clearly and uniquely defines the first functional designator for the passenger with a disability.

In further embodiments, an elevator installation comprises a call input device that transmits the first input signal to at least one destination call controller or elevator controller. The destination call controller or the elevator controller changes the elevator installation to at least one specific operating mode for a received first input signal.

Some embodiments comprise a method for retrofitting an elevator installation with a call input device having at least one touchscreen for inputting at least one call for an elevator installation.

Further embodiments comprise a method for retrofitting an elevator installation with a call input device having at least one touchscreen for inputting at least one call for an elevator installation. At least one computer program means is loaded into at least one processor of the call input device, and the call input device is changed to at least one specific input mode by the computer program means for producing a plurality of input signals on a time and/or position basis.

This can mean that an existing call input device is provided with the capability, by downloading the computer program means, to change to a specific input mode for producing a plurality of input signals on a time and/or position basis.

Some embodiments describe a method for retrofitting an elevator installation with a call input device having at least one touchscreen for inputting at least one call for an elevator installation. At least one computer program means is loaded into at least one processor in the call input device, which computer program means monitors the production of at least one input signal independently of at least one other loaded computer program means in the call input device, and the call input device is changed to at least one specific input mode by the computer program means for producing a plurality of input signals on a time and/or position basis.

This can mean that normal operation of an existing call input device is not adversely affected by downloading the computer program means. In some cases the downloaded computer program means comes into action only when a plurality of input signals are produced, changing the call input device to the specific input mode, leading to an elevator installation without any disadvantages.

Further embodiments describe a method for retrofitting an elevator installation with a call input device having at least one touchscreen for inputting at least one call for an elevator installation, wherein at least one identifier is attached to the call input device in a force-fitting and/or interlocking and/or integral form, such that the identifier identifies at least one first functional designator.

This can mean that an existing elevator installation can be easily and quickly retrofitted with a call input device having at least one touchscreen.

Additional embodiments describe a method for retrofitting an elevator installation with a call input device having at least one touchscreen for inputting at least one call for an elevator installation, wherein at least one identifier is attached in a force-fitting and/or interlocking and/or integral form to the call input device, such that the identifier identifies at least one first functional designator by means of at least one Braille script character which is fitted to the identifier and has a height of at least 0.8 mm.

In additional embodiments, a computer program product comprises at least one computer program means which is suitable for implementing the method for operation of an elevator installation, in that at least one method step is carried out when the computer program means is loaded in at least one processor of at least one call input device or at least one destination call controller or at least one elevator controller. Possibly, the computer-legible data memory comprises a computer program product such as this.

BRIEF DESCRIPTION OF THE DRAWINGS

Exemplary embodiments will be explained in detail with reference to the figures, in which, in some cases schematically.

DETAILED DESCRIPTION

Figure 1:
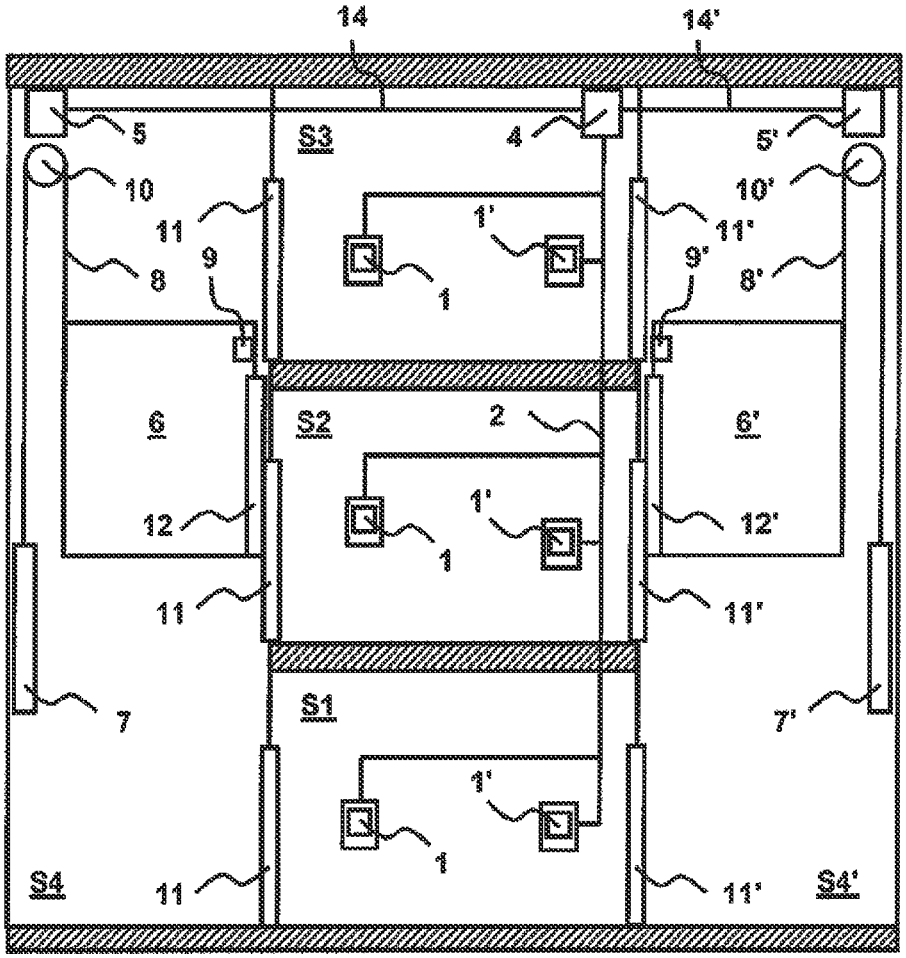
FIG. 1 shows a first exemplary embodiment of an elevator installation having a call input device as shown in FIGS. 3 to 8.
Figure 2:
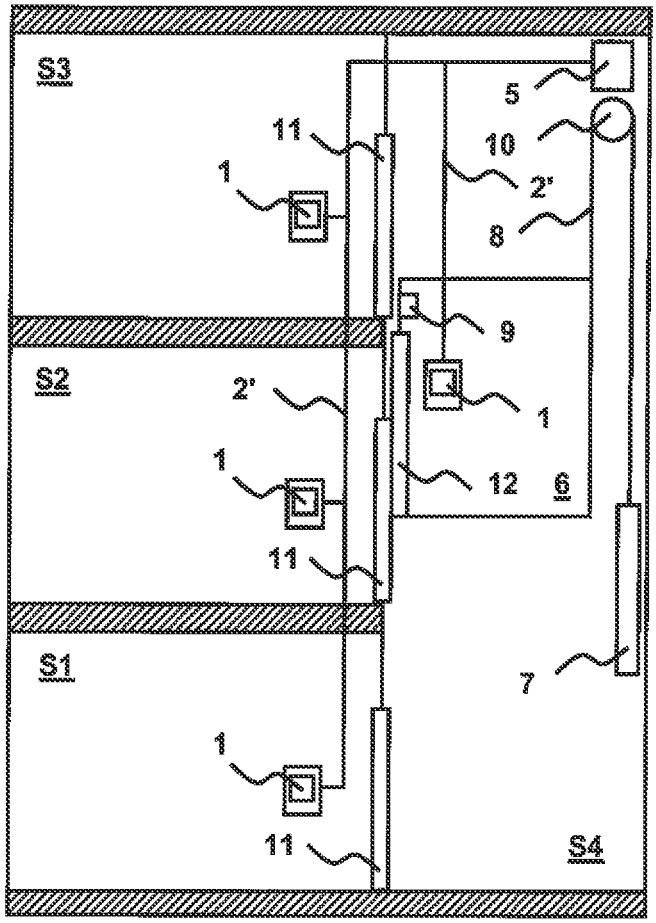
FIG. 2 shows a second exemplary embodiment of an elevator installation having a call input device as shown in FIGS. 3 to 8.

FIGS. 1 and 2 show two exemplary embodiments of an elevator installation in a building. The building has a relatively large number of floors S1 to S3, which are served by at least one elevator car 6, 6'. A passenger can enter and leave the elevator car 6, 6' on each floor S1 to S3 via at least one elevator door 11, 11', 12, 12'. In at least one elevator shaft S4, S4', the elevator car 6, 6' is connected to at least one counterweight 7, 7' via at least one supporting means 8, 8'. In order to move the elevator car 6, 6' and the counterweight 7, 7', the supporting means 8, 8' is set in motion by a friction drive by at least one elevator drive 10, 10'. Normally, at least one door drive 9, 9' is arranged on the elevator car 6, 6', and operates the elevator door 11, 11', 12, 12'. In the case of the elevator door 11, 11', 12, 12', a distinction is drawn between a floor door 11, 11', which is arranged on each floor S1 to S3, and a car door 12, 12' of the elevator car 6, 6'. While stopped at a floor, the car door 12, 12' can be operatively connected to the floor door 11, 11' by a mechanical coupling, such that the car door 12, 12' and the floor door 11, 11' are opened and closed at the same time. As shown in FIG. 1, two elevator cars 6, 6' are arranged in two elevator shafts S4, S4'. As shown in FIG. 2, an elevator car 6 is arranged in an elevator shaft S4. With knowledge of the present disclosure, a person skilled in the art can produce an elevator installation which serves more than three floors S1 to S3 and/or more than one elevator car 6, 6' per elevator shaft S4, S4', and/or a hydraulic drive and/or an elevator drive on the elevator car and/or on the counterweight and, of course, also an elevator installation without a counterweight.

At least one elevator controller 5, 5' has at least one processor and at least one computer-legible data memory. At least one computer program means is loaded from the computer-legible data memory into the processor, and is run. The computer program means operates the elevator drive 10, 10' and the door drive 9, 9'. At least one adapter for at least one Bus system 2' and/or at least one adapter for at least one signal line 14, 14', as well as at least one electrical power supply are arranged in at least one housing of the elevator controller 5, 5'.

At least one call input device 1, 1' is arranged close to a floor door 11, 11' or in an elevator car 6. The call input device 1, 1' is mounted on a building wall in the floor door area and is positioned in an isolated form in the floor door area of the floors S1 to S3. At least one adapter for a Bus system 2, 2', at least one input/output appliance in the form of a touchscreen 13, at least one tone transmitter 15, at least one microphone 18, and at least one electrical power supply are arranged in at least one housing of the call input device 1, 1'. The call input device 1, 1' has at least one processor and at least one computer-legible data memory. At least one computer program means is loaded from the computer-legible data memory into the processor, and is run. A plurality of computer program means which operate individually or together can be loaded into the processor of the call input device 1, 1'. The computer program means operates the adapter and/or the touchscreen 13 and/or the tone transmitter 15 and/or the microphone 18.

At least one destination call controller 4 has at least one processor, at least one computer-legible data memory, at least one adapter for a Bus system 2, and at least one electrical power supply. As shown in FIG. 1, the destination call controller 4 is an autonomous electronic unit in at least one housing of its own which, for example, is placed on the floor S3. The destination call controller 4 can also be an electronic withdrawable insert, for example in the form of a printed circuit board, which printed circuit board is arranged in the housing of a call input device 1, 1' or of an elevator controller 5, 5'.

The call input device 1, 1' and the destination call controller 4 and the elevator controller 5, 5' communicate bidirectionally via a Bus system 2, 2', such as a Universal Serial Bus (USB), Local Operating Network (LON), Modbus, Ethernet, etc. Communication takes place in the Bus system 2, 2' on the basis of a known protocol. As shown in FIG. 1, on each floor S1 to S3, two call input devices 1, 1' are connected for communication purposes to the destination call controller 4 via the Bus system 2. As shown in FIG. 2, on each floor S1 to S3, a call input device 1 is connected for communication purposes to an elevator controller 5 via a Bus system 2'. Each communication subscriber can be identified uniquely via an address of an adapter in the Bus system 2, 2'. The destination call controller 4 and the elevator controller 5, 5' communicate bidirectionally via a signal line 14, 14'. As shown in FIG. 1, the destination call controller 4 is connected for communication purposes to an elevator controller 5, 5' via a respective signal line 14, 14'. The communication subscribers can be identified uniquely at the ends of the permanently activated signal lines 14, 14'. With knowledge of the present disclosure, a person skilled in the art can combine the exemplary embodiments of an elevator installation as shown in FIGS. 1 and 2 with one another, for example such that a call input device 1, 1' is connected for communication purposes to a plurality of elevator controllers 5, 5' via a bus system 2', and/or such that a destination call controller 4 is connected for communication purposes to only one elevator controller 5, 5' via a signal line 14, 14'.

As shown in FIG. 1, the call input device 1, 1' in the Bus system 2 transmits a call, which is made by the passenger, as a destination call to the destination call controller 4. As shown in FIG. 2, the call input device 1 in the bus system 2' transmits a call, which is made by the passenger, as a floor call or as a car call to the elevator controller 5. In the case of a floor call, an elevator car 6 is first of all moved to the floor of the call input device 1. Once the passenger has entered the elevator car 6, a car call to a destination floor is made on a call input device 1 in the elevator car 6, and the elevator car 6 is moved to this destination floor. In the case of a destination call, a designation of a desired destination floor will have already been made during the call input, as a result of which there is no longer any need for a car call. The destination call controller 4 therefore already knows the destination floor when the call is input, and can therefore optimize not only the approach to the call input floor but also that to the destination floor. The destination call controller 4 determines at least one best call allocation for a destination call. The best call allocation denotes a movement by at least one elevator car 6, 6' from a starting floor to a destination floor with the shortest possible waiting time and/or the shortest possible time to the destination. The starting floor need not match the call input floor. In addition, the destination floor need not match the destination floor desired by the passenger on the basis of the destination call. When assigning the best call allocation to the elevator car 6, 6', at least one start call signal and at least one destination call signal are produced, and are transmitted via the signal line 14, 14' to the adapter for the elevator controller 5, 5' for this elevator car 6, 6'.

The touchscreen 13 is rectangular or has a circular symmetrical diameter. By way of example, the touchscreen 13 has a diameter of 5 cm and a thickness of 2 to 10 mm. The display is composed, for example, of glass or impact-resistant plastic, such as polyurethane, polypropylene, polyethylene etc. By way of example, a front face of the touchscreen 13 is composed of glass or impact-resistant plastic such as polyurethane, polypropylene, polyethylene. The front face of the touchscreen 13 can be seen by a passenger and can be touched directly by the passenger, for example using a finger. A plurality of functional principles of touchscreens 13 are known:

In the case of a resistive touchscreen 13, when the touchscreen 13 is touched, an electrical contact is made between two previously electrically isolated electrically conductive layers. The electrical resistance of this electrical contact can be detected by at least one sensor as an input signal, with two-dimensional position resolution via a position coordinate.

In the case of a capacitive touchscreen 13, an electrical field applied to the display is changed when the touchscreen is touched. This electrical field change can also be detected by at least one sensor as an input signal with two-dimensional position resolution via a position coordinate.

In the case of an optical touchscreen 13, a light beam is interrupted when the touchscreen 13 is touched. The position of the light-beam interruption can be detected by at least one sensor as an input signal with two-dimensional position resolution via a position coordinate.

In the case of a surface wave touchscreen 13, horizontal and vertical ultrasound waves are reflected when the touchscreen 13 is touched. This ultrasound wave reflection can also be detected by at least one sensor as an input signal with two-dimensional position resolution via a position coordinate.

The microphone 18 can receive at least one command, which is spoken by the passenger, and for this purpose produces at least one analog speech signal. The command is a digit and/or a letter and/or a word. The analog speech signals are broken down into frequency sequences and are digitized by at least one analog/digital converter. At least one frequency spectrum is produced from digitized speech signals by means of Fourier transformation. The reference spectrum is compared with at least one reference spectrum. At least one input signal is associated with each reference spectrum. The reference spectrum and the input signal are stored in the computer-legible data memory of the call input device 1, 1'. A reference spectrum which is most similar to the frequency spectrum is selected, and the input signal associated with that reference spectrum is read. The computer program means in the call input device 1, 1' in this way carries out voice recognition of a command. By way of example, the passenger speaks at least one number or number sequence consisting of digits "0" to "9" for the floor input. For example, the passenger speaks at least one position designator such as "lobby", "library", etc., and/or at least one name designator such as "Schmidt family", "Meier Company", etc. By way of example, the passenger speaks at least one function designator such as "help", "alarm", "disabled", "disability", "VIP" (very important person), etc. At least one first analog speech signal is stored, identified as the first input signal. By way of example, a function designator such as "disabled", "disability", "VIP" is identified as the first input signal. At least one further analog speech signal is stored identified as a further input signal. By way of example, a number or number sequence such as "1", "3" and/or a position designator such as "lobby", "library" is identified as a further input signal.

Figure 3:
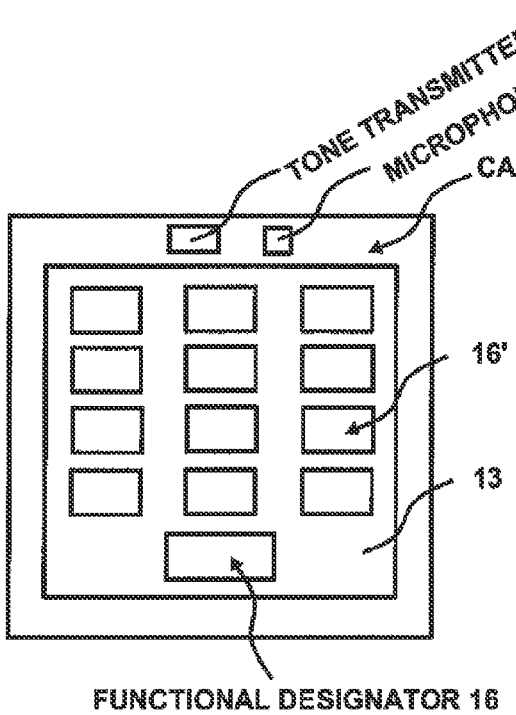
FIG. 3 shows a view of a part of a first exemplary embodiment of a call input device having a functional designator.
Figure 4:
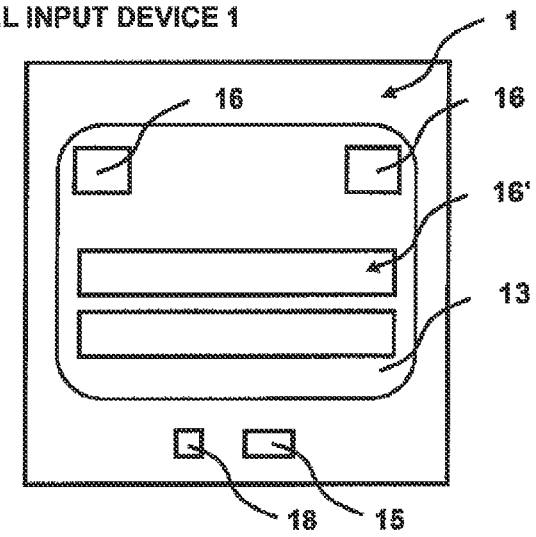
FIG. 4 shows a view of a part of a second exemplary embodiment of a call input device having a functional designator.
Figure 5:
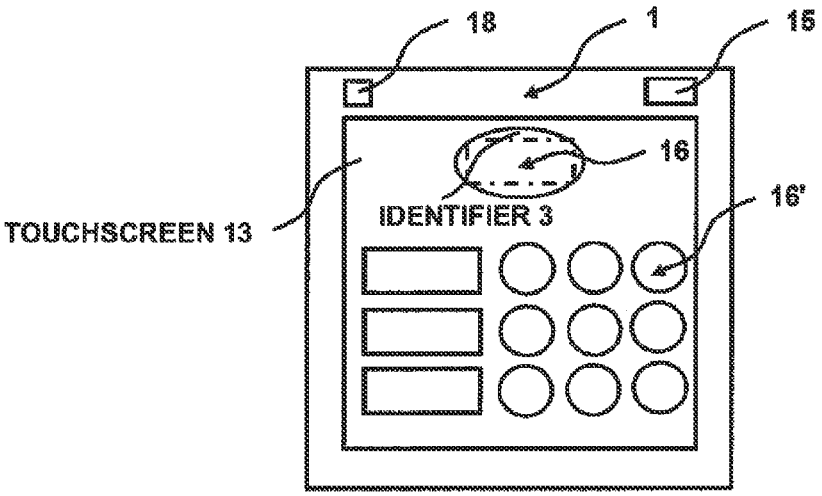
FIG. 5 shows a view of a part of a third exemplary embodiment of a call input device having a functional designator.

That surface of the touchscreen 13 which can be seen by the passenger has at least one functional designator 16, 16'. The functional designators 16, 16' are pictograms or alphanumeric character sequences. The functional designators 16, 16' are produced by at least one light-emitting element such as a liquid crystal display (LCD), light emitting display (LED) or organic light emitting display (OLED), etc. Each light-emitting element can be operated by the computer program means, and the number, size, color and shape of the functional designators 16, 16' are freely programmable. The functional designator 16, 16' can also be a "blank area" on the touchscreen 13, i.e. a uniform area on the touchscreen 13 which is currently not identified in a particular way. As shown in FIG. 3, a first functional designator 16 is arranged on a lower edge area of the touchscreen 13, and twelve further functional designators 16' are arranged above this, in a central area of the touchscreen 13. As shown in FIG. 4, two first functional designators 16 are arranged on left and right upper corner areas of the touchscreen 13, and two further functional designators 16' are arranged in a central area of the touchscreen 13. As shown in FIG. 5, a first functional designator 16 is arranged on an upper edge area of the touchscreen and twelve further functional designators 16' are arranged below this in a central area of the touchscreen 13.

Figure 8:
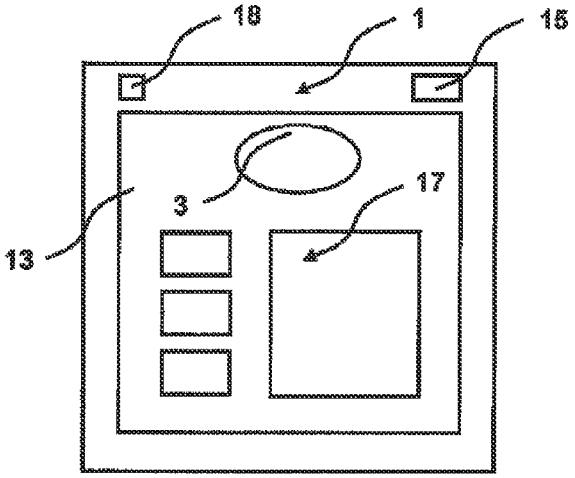
FIG. 8 shows a view of a part of the third exemplary embodiment of a call input device as shown in FIG. 5 with an acknowledgement signal.

The first functional designator 16 may be identified specifically. By way of example, the first functional designator 16 is identified by a wheelchair user pictogram. By way of example, as shown in FIGS. 5 and 8, at least one identifier 3 with at least one Braille script character with a height of at least 0.8 mm is fitted on the touchscreen 13 in the input area of the first functional designator 16. By way of example, the first functional designator 16 is identified by a VIP text script. The further functional designators 16' are, for example, digits "0" to "9" for floor input as well as a "bell symbol" for an alarm, and/or at least one position designator such as "lobby", "library", etc., and/or at least one name designator such as "Schmidt family", "Meier Company", etc.

An input signal is produced by touching a functional designator 16, 16'. The call input device 1, 1' changes to at least one specific input mode for producing a plurality of input signals on a time and/or position basis. A number of types of production of the plurality of input signals on a time and/or position basis are possible:

- A plurality of position-based input signals are produced when a functional designator 16, 16' is touched for a long time. By way of example, a passenger touches a functional designator 16, 16' on the touchscreen 13 for a plurality of seconds, preferably three seconds, and preferably five seconds.
- A plurality of position-based input signals are produced when a functional designator 16, 16' is touched with a specific pressure force. By way of example, a passenger touches a functional designator 16, 16' on the touchscreen 13 with a pressure force of 2.5 N to 5.0 N.
- A plurality of time-based input signals are produced when a plurality of functional designators 16, 16' are touched at the same time. By way of example, as shown in FIG. 4, a passenger touches the two first functional designators 16 on the touchscreen 13 at the same time. By way of example, the passenger places the surface of a hand on the touchscreen 13, and thus touches a plurality of functional designators 16, 16' at the same time. By way of example, the passenger touches the entire touchscreen 13, and thus touches a plurality of functional designators 16, 16' at the same time.
- A plurality of position-based input signals are produced when a functional designator 16, 16' is touched at specific times. By way of example, a passenger touches a functional designator 16, 16' on the touchscreen 13 a plurality of times within a number of seconds, preferably three times within three seconds, and preferably five times within five seconds. The specific-timed touching can also be carried out by using a specific rhythm or a specific rhythmic form. By way of example, the passenger can use an identification melody, a Morse character sequence, etc.

A plurality of position-based input signals are produced when a plurality of functional designators 16, 16' are touched at specific times. By way of example, a passenger touches a series of functional designators 16, 16' on the touchscreen 13 in accordance with at least one geometric pattern. The geometric pattern is a digit or a letter or a straight line or a curved line or a multiple line. The number is, for example, a "6" or a "22" or a "0", etc. The call input device 1, 1' identifies this number "6" or "22" or "0" and associates a call signal for a sixth or a twenty-second or a zero destination floor with the respectively identified number "6", "22" or "0". By way of example, the letter is an "A" or a "C", or "garage" or "office", etc. The call input device 1, 1' identifies these letters "A", "C", "garage" or "office" and associates a call signal to the appropriate destination floor with the identified letters "A", "C", "garage" or "office". By way of example, the straight line is a straight line pointing "upward" or "downward" on the touchscreen 13, or a diagonal on the touchscreen 13, and/or a semicircle and/or a circle on the touchscreen 13. The call input device 1, 1' identifies this straight line, and associates a function with it. By way of example, the call input device 1, 1' associates a call signal in the "upward direction" with a straight line pointing "upward", and associates a call signal in the "downward direction" with a straight line pointing "downward". By way of example, the passenger scrolls through a menu having a plurality of functional designators 16, 16'. The passenger uses a straight line pointing upward to scroll in the upward direction through the menu, and the passenger uses a straight line pointing downward to scroll in the upward direction through the menu. The multiple line is produced, for example, by the passenger using one or more fingers to touch the screen 13 at specific times. By way of example, the passenger touches the touchscreen with his index finger and ring finger at the same time, and then moves the finger tips of these two fingers relative to one another, while maintaining the contact on the touchscreen 13. In this way, the passenger can spread his fingers apart, such that the finger tips move away from one another on the touchscreen, and/or he can move his fingers together, such that the finger tips approach one another. The multiple line is, for example, a multiple line which extends from a center to two or three extremities, and/or a multiple line meeting at a center from a plurality of extremities. The call input device 1, 1' identifies this multiple line, and associates a function with it. By way of example, the passenger scrolls through a menu having a plurality of functional designators 16, 16'. The passenger opens a menu by a multiple line extending from a center to a plurality of extremities; the passenger closes a menu by a multiple line which meets at a center from a plurality of extremities.

Alternatively and/or additionally, the call input device 1, 1' changes to at least one specific input mode when associated with at least one first input signal. By way of example, the passenger speaks a command "disability" into the microphone 18. The microphone 18 produces an analog speech signal for the command, which analog speech signal is associated with a first input signal "disability" by the call input device 1, 1'.

With knowledge of the present disclosure, these forms of production of a plurality of input signals on a time and/or position basis can be combined with one another. By way of example, a passenger can place the surface of a hand on the touchscreen 13, thus touching a plurality of functional designators 16, 16' at the same time for a plurality of seconds. The production of input signals on a time and/or position basis can also be combined with the association with a first input signal. By way of example, a passenger sweeps over a diagonal series of functional designators 16, 16' on the touchscreen 13, and speaks the command "disability".

A first input signal is produced when a first functional designator 16 is touched in the specific input mode. Alternatively or additionally, a first input signal is produced on allocation of a first input signal. The call input device 1, 1' transmits the first input signal to the destination call controller 4 and/or the elevator controller 5, 5'. The destination call controller 4 or the elevator controller 5, 5' changes the elevator installation to at least one specific operating mode for a received first input signal. By way of example, the elevator installation is changed to a specific operating mode by touching the first functional designator 16 or by allocating a first input signal "disability" for a predetermined time period of five seconds to twenty seconds.

A further input signal is produced by touching a further functional designator 16'. By way of example, a passenger wishes to select a destination floor which corresponds to the floor S3. As soon as the passenger uses a finger to touch the further functional designator 16' in the form of a "3", a further input signal is produced. Alternatively and/or in addition to this, a further input signal is produced on association with a further input signal. By way of example, the passenger speaks the command "3" into the microphone 18. The microphone 18 produces an analog speech signal for the command "3", with which analog speech signal the call input device 1, 1' associates a further input signal "3", and for which further input signal "3", a further input signal is produced. The call input device 1, 1' associates at least one call signal with the further input signal. The call input device 1, 1' transmits the call signal to the destination call controller 4 and/or the elevator controller 5, 5'. The destination call controller 4 or the elevator controller 5, 5' makes at least one call for the transmitted call signal. By way of example, the destination call controller 4 and/or the elevator controller 5, 5' makes a call to the destination floor desired by the passenger.

Touching the first functional designator 16 and touching the further functional designator 16' on one and the same call input device 1, 1' changes the elevator installation to a specific operating mode until the call made by touching the further functional designator 16' has been carried out completely. A floor call is completed when the passenger has entered an elevator car 6, 6' at the starting floor; a car call or destination call is completed when the elevator door 11, 11', 12, 12' has been completely opened at the destination floor. Therefore, when a first functional designator 16 is touched, followed by a further functional designator 16' being touched on one and the same call input device 1, 1' during the specific operating mode, the call made in this way is handled using the specific operating mode.

In the specific operating mode, a passenger is transported by the elevator installation in the building without being disadvantaged by a given disadvantage. The disadvantage may be a disability of the passenger or a potential safety or security hazard to the passenger. In the simplest case, the first input signal indicates in binary form whether the passenger is or is not disabled and/or whether the passenger is or is not subject to a safety or security hazard.

The first input signal can indicate in detail the nature of the disability, such as a physical disability, blindness, deafness, etc. The disability may be a physical disability or a mental disability. For example, it may be possible for the passenger to move or be oriented in the building only using at least one disabled-specific aid. By way of example, a disabled-specific aid is a wheelchair, a hospital bed on rollers, a crutch, a hearing aid, a vision aid, a blind person's stick, a guide dog for the blind, etc. It is also possible for a severely disabled passenger to be able to move only with the aid of at least one accompanying passenger. For example, an accompanying passenger pushing the wheelchair of the severely disabled passenger makes a call input for the severely disabled passenger.

It is also possible for the first input signal to indicate whether the passenger with the disability requires passive personal protection or active personal protection. For example, it may be possible for the passenger to move in the building only using at least one personal-protection-specific aid. By way of example, a personal-protection-specific aid is a three-dimensional protection zone or a time protection zone, or a personal protector. For example, a three-dimensional protection zone or a time protection zone with as few other passengers in the elevator car 6, 6' as possible is produced for the passenger with a disability. To this end, other passengers may be transported by the elevator car 6, 6' at earlier or later times. It is also possible for a passenger who is subject to an acute safety or security hazard to be accompanied by at least one personal protector in the elevator car 6, 6'.

In the specific operating mode, the call input device 1, 1' and/or the elevator door 11, 11', 12, 12' and/or the elevator car 6, 6' can be operated as follows:

For a passenger having a disabled-specific aid, the elevator door 11, 11', 12, 12' is closed with a particularly long delay, and it is closed particularly slowly. While, in the normal operating mode, an elevator door 11, 11', 12, 12' is closed after a delay of two to twenty seconds and the elevator door 11, 11', 12, 12' requires around two seconds for the closing process, the delay and the closing process for a passenger with a disabled-specific aid are 10% to 50% more.

For a passenger with a disability-specific aid, the elevator car 6, 6' is stopped with particular accuracy at the floor S1 to S3. While, in the normal operating mode, the height difference between a floor of the elevator car 6, 6' and a threshold of the floor door 11, 11' may be more than 10 mm, a maximum height difference between the floor of the elevator car 6, 6' and the threshold of the floor door 11, 11' of +/−10 mm is stipulated in accordance with EN81-70 for a passenger with a disabled-specific aid.

A passenger with a disabled-specific aid or a personal-protection-specific aid is assigned a particularly large amount of space in an elevator car 6, 6'. While, in the normal operating mode, an elevator car 6, 6' with a payload of 450 kg can accommodate up to six passengers, this elevator car 6, 6' with a payload of 450 kg is assigned a single passenger with a disabled-specific aid or a personal-protection-specific aid. Analogously, an elevator car 6, 6' with a payload of 630 kg, which can accommodate up to eight passengers in the normal operating mode, is assigned one passenger with a disabled-specific aid as well as an accompanying passenger, and/or a safety or security-endangered passenger as well as a personal protector.

A passenger with a personal-protection-specific aid is transported by the elevator car 6, 6' directly from the call input floor to the destination floor. While, in the normal operating mode, the elevator car 6, 6' makes one or more intermediate stops or changeover stops, a passenger with a personal-protection-specific aid is transported from the call input floor to the desired destination floor without any intermediate stops or changeover stops.

Figure 6:
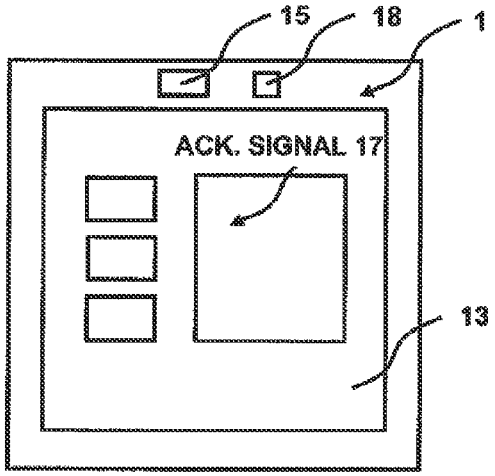
FIG. 6 shows a view of a part of the first exemplary embodiment of a call input device as shown in FIG. 3 with an acknowledgement signal.
Figure 7:
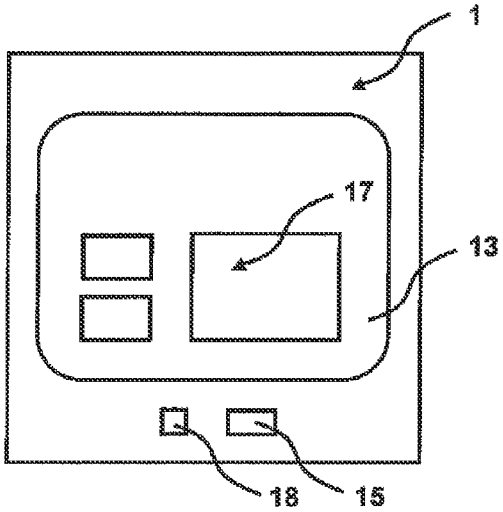
FIG. 7 shows a view of a part of the second exemplary embodiment of a call input device as shown in FIG. 4 with an acknowledgement signal.

In at least some embodiments, every input signal is confirmed visually and/or audibly by at least one acknowledgement signal 17 on the touchscreen 13 and/or by the tone transmitter 15. The passenger therefore receives a visual or audible acknowledgement that a functional designator 16, 16' on the touchscreen 13 has been touched. The acknowledgement signal 17 on the touchscreen 13 is a pictogram and/or alphanumeric character sequences, and is produced by at least one light-emitting element, such as a liquid crystal display (LCD), light emitting display (LED) or organic light emitting display (OLED), etc. Each light-emitting element can be operated by the computer program means, and the number, size, color and shape of the acknowledgment signal 17 on the touchscreen 13 is freely programmable. As shown in FIGS. 6 and 8, a plurality of acknowledgement signals 17 are arranged in a central area of the touchscreen 13. The acknowledgment signal 17 produced by the tone transmitter 15 is, for example, a tone sequence, melody, or a synthetic voice output. Each acknowledgement signal 17 uniquely acknowledges an input signal correlated with a functional designator 16, 16'. With knowledge of the present disclosure, the acknowledgement signal can, of course, also be output on a different elevator installation output device, which is physically separated from the call input device 1, 1'. A different output device such as this is, for example, a car status indication above the floor door 11, 11', or a floor indication within the elevator car 6, 6'. A plurality of acknowledgement signals 17 can be output on the touchscreen 13 or tone transmitter 15:

Confirmation of the change of the elevator installation to the specific operating mode. A wheelchair user pictogram is output on the touchscreen 13, and the tone transmitter 15 outputs a tone at, for example, 600 Hz to the passenger, as an acknowledgement signal 17. In the specific operating mode, it is also possible to output larger and/or brighter and/or more contrasting alphanumeric character strings on the touchscreen 13. While, for example in the normal operating mode, alphanumeric character sequences may also have a height of less than 15 mm, they are at least 15 mm high, and preferably at least 18 mm high, in the specific operating mode.

Confirmation of the change of the elevator installation to the normal operating mode. A passenger pictogram is output on the touchscreen 13, and the tone transmitter 15 outputs a tone at, for example, 400 Hz to the passenger, as an acknowledgment signal 17.

Confirmation of the call input by the passenger. An "OK" is output on the touchscreen 13, and the tone transmitter 15 outputs a tone at, for example, 500 Hz to the passenger, as an acknowledgement signal 17.

Request for the communication language desired by the passenger. A plurality of national flags, such as that of the United Kingdom for English, that of the USA for US-American, that of Germany for German, that of France for French, that of China for Chinese, etc., are output on the touchscreen 13, as an acknowledgement signal 17. At the same time, the tone transmitter 15 produces an appropriate synthetic voice output in the respective language.

Request for the nature of the disability of the passenger. A plurality of possible types of passenger disabilities are output on the touchscreen 13, as an acknowledgement signal 17. For example, this requests whether the passenger can move and/or can be oriented in the building only using at least one disabled-specific aid, and/or whether the passenger can move in the building only using at least one personal-protection-specific aid. At the same time, the tone transmitter 15 produces an appropriate synthetic voice output.

Provision of at least one aid. At least one assistance text is output on the touchscreen 13, and/or the tone transmitter 15 outputs at least one synthetic assistance text, as an acknowledgement signal 17.

Designation of the direction of travel desired by the passenger. An arrow pointing "upward" or "downward" is output on the touchscreen 13 to the passenger, as an acknowledgement signal 17. The arrow or the background of the arrow can blink. For an "upward" direction of travel, the tone transmitter 15 outputs a high tone of, for example, 550 Hz to the passenger, while for a "downward" direction of travel, the tone transmitter 15 outputs a low tone of, for example, 450 Hz to the passenger.

Designation of the destination floor desired by the passenger. For a destination floor which is desired by the passenger and which destination floor corresponds to the floor S3, a "3" is output on the touchscreen 13, and the tone transmitter 15 outputs a tone sequence of, for example, three tones at 490 Hz, 500 Hz and 510 Hz, to the passenger as an acknowledgement signal 17.

Designation of the elevator shaft S4, S4', from which a call is being made. The elevator shaft S4, S4' of the elevator car 6, 6' which is handling the call from the passenger is output on the touchscreen 13 in the form of a letter "B" and the tone transmitter 15 outputs a tone at 400 Hz, as an acknowledgment signal 17. The letter "B" and/or the background can blink.

Designation of the elevator car 6, 6', which will handle the call. When there are a plurality of elevator cars 6, 6' in one elevator shaft S4, S4', for example an upper and a lower elevator car 6, 6' of a double-decker elevator, then the elevator car 6, 6' which is handling the call from the passenger is output on the touchscreen 13 in the form of a number "2" and by a melody, as an acknowledgment signal 17. The number "2" and/or the background can blink. This communicates to the passenger that he should enter the second elevator car 6, 6'.

Output of the start and the duration of the opening/closing of the elevator door 11, 11', 12, 12'. The passenger is warned of the start and the duration of the opening/closing of the elevator door 11, 11', 12, 12' by blinking of the touchscreen 13 and by the tone transmitter 15 outputting a tone at 500 Hz in time with the blinking Output of the arrival time of the elevator car 6, 6' at the starting floor and/or destination floor. An arrival time of the elevator car 6, 6' is indicated in digital form on the touchscreen 13, for example as a numerical sequence "14 s", "13 s", etc., counting backwards. At the same time, the tone transmitter 15 produces an appropriate synthetic voice output.

At least one input area on the touchscreen 13 is a multipurpose area, such that the passenger can use the time duration of touching the input area on the touchscreen 13 to select one of a plurality of functional designators 16, 16'. When the input area on the touchscreen 13 is touched for a long time, a plurality of input signals are produced. When the touch ends, the most recently produced input signal is selected. In at least some cases, the call input device 1, 1' transmits only the selected further input signal to the destination call controller 4 and/or the elevator controller 5, 5'.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

The invention claimed is:

1. A method for retrofitting an elevator installation, the elevator installation comprising a call input device having a processor and at least one touchscreen for inputting at least one call for an elevator installation, the method comprising:

loading a computer program into the processor of the call input device, when being executed by the processor, the computer program causing the processor:

to generate a plurality of input signals in response to a touching of two or more functional designators displayed on the touchscreen;

to determine whether at least one of the plurality of input signals satisfy at least one predetermined criteria for a specific input mode by correlating the plurality of input signals with one another based on the positions on the touchscreen of the two or more of the plurality of the functional designators touched and the time at which each of the two or more of the plurality of functional designators is touched; and upon determining that at least one of the plurality of input signals satisfy the at least one predetermined criteria, to change the call input device to the specific input mode.

2. The method of claim 1, the computer program further causing the processor:

in the specific input mode, to generate at least one additional input signal in response to a touching of at least one functional designator on the touchscreen; and to associate at least one call signal with the at least one additional input signal.

3. The method of claim 1, wherein the touching of the two or more of the plurality of functional designators constitutes a geometric pattern.

4. The method of claim 1, wherein the call input device comprises at least one microphone, the computer program further causing the processor to associate, using the call input device, at least one input signal with at least one speech signal generated by the microphone.

5. The method of claim 4, wherein the at least one additional speech signal is generated by the microphone, the computer program further causing the processor to associate, using the call input device, at least one other input signal with the at least one additional speech signal.

6. The method of claim 1, the computer program further causing the processor to provide at least one visual or audio confirmation of the at least one input signal.

7. The method of claim 3, wherein the geometric pattern is selected from the group consisting of a digit, a letter, a straight line, a curved line and a multiple line.

8. A computer implemented method for retrofitting an elevator installation with a call input device having a computer processor including computer program instructions configured to be executed by the processor, and at least one user input for inputting at least one call for an elevator installation, the computer implemented method comprising:

generating, by the computer processor executing the computer program instructions, a plurality of input signals in response to activating, using a specific input mode, two or more functional designators;

determining, by the computer processor executing the computer program instructions, whether the plurality of input signals satisfy at least one predetermined criteria for the specific input mode based on the two or more of the plurality of the functional designators and activation criteria associated with each of the two or more of the plurality of functional designators; and upon determining that at least one of the plurality of input signals satisfy the at least one predetermined criteria, changing, by the computer processor executing the computer program instructions, the call input device to the specific input mode enabling the call input device to receive a command input corresponding to the specific input mode.

9. A computer implemented method according to claim 8, wherein prior to changing the call input device to the specific input mode, the call input device was not enabled to process the command input.

10. A computer implemented method according to claim 9, further comprising performing an action by the elevator installation responsive to the specific input mode.

11. A computer implemented method according to claim 10, wherein prior to changing the call input device to the specific input mode, the elevator installation does not perform the action.

12. A computer implemented method according to claim 8, further comprising performing an action by the elevator installation responsive to the specific input mode.

* * * * *